US010122113B1

(12) United States Patent
Bonucci et al.

(10) Patent No.: US 10,122,113 B1
(45) Date of Patent: Nov. 6, 2018

(54) CONNECTOR ASSEMBLY WITH INDEPENDENT SECONDARY LOCK WITH RESILIENT POSITIONING MEMBER

(71) Applicant: TYCO ELECTRONICS BRASIL LTDA., Braganca Paulista (BR)

(72) Inventors: Gustavo Bonucci, Braganca Paulista (BR); Jose Roberto Goldschmidt, Campinas (BR); Fabio Fortunato Christiano, Itapira (BR); Natanael Marcondes Santos, Braganca Paulista (BR); Gentil Pinto de Oliveira Junior, Braganca Paulista (BR)

(73) Assignee: TE CONNECTIVITY BRASIL INDUSTRIA DE ELECTRONICOS LTDA., Sao Paulo (BR)

( * ) Notice: Subject to any disclaimer, the term of this patent is extended or adjusted under 35 U.S.C. 154(b) by 0 days.

(21) Appl. No.: 15/831,952

(22) Filed: Dec. 5, 2017

(51) Int. Cl.
*H01R 13/40* (2006.01)
*H01R 13/436* (2006.01)
*H01R 13/428* (2006.01)

(52) U.S. Cl.
CPC ..... *H01R 13/4362* (2013.01); *H01R 13/428* (2013.01)

(58) Field of Classification Search
CPC ..... H01R 13/4362; H01R 13/40; H01R 13/4361; H01R 13/113; H01R 13/62955; H01R 13/428
USPC ..... 439/595
See application file for complete search history.

(56) References Cited

U.S. PATENT DOCUMENTS 6,827,593 B2 * 12/2004 Shinozaki ..... H01R 13/62955 439/157
2014/0242824 A1 * 8/2014 Karadimas ..... H01R 13/113 439/181
2017/0222349 A1 * 8/2017 Kleymann ..... H01R 13/4361
2017/0338601 A1 * 11/2017 Takahashi ..... H01R 13/40
2018/0023981 A1 * 1/2018 Forwerck ..... B60R 16/0231

* cited by examiner

*Primary Examiner* — Jean F Duverne

(57) ABSTRACT

A connector assembly having a connector housing with a terminal receiving area. The terminal receiving area is spaced from outside walls of the connector housing and has a secondary lock receiving recess and terminal receiving cavities. A secondary lock member is slidably received in the secondary lock receiving recess for movement between a first position and a second position. The secondary lock member cooperates with terminals positioned in the terminal receiving cavities when the secondary lock member is in the second position. The secondary lock member has a resilient positioning member extending from a first wall of the secondary lock member in a direction away from the terminal receiving area. The resilient positioning member is configured to engage a mating component and compress when the mating component is inserted into the connector housing.

20 Claims, 7 Drawing Sheets

CONNECTOR ASSEMBLY WITH INDEPENDENT SECONDARY LOCK WITH RESILIENT POSITIONING MEMBER

FIELD OF THE INVENTION

The present invention is directed to an electrical connector with an independent secondary lock. In particular, the invention is directed to a compact electrical connector with an independent secondary lock with a resilient positioning member.

BACKGROUND OF THE INVENTION

Conventional connectors include a connector body, lock projections and either a primary lock reinforcement or an independent secondary lock. The lock projections engage a rearward edge of terminals to retain the terminals in terminal cavities. Typically, the primary lock reinforcement and the independent secondary lock are adjusted to pre-set positions until the terminals are inserted into the terminal cavities, at which point the primary lock reinforcement and the independent secondary lock are independently moved to full-set positions. In its full-set position, the primary lock reinforcement engages the lock projections to prevent the lock projections from deflecting away from terminal cavities. In its full-set position, the independent secondary lock engages a rearward edge of the terminals to retain the terminals in the terminal cavities independent from the lock projections.

The decision to use a primary lock reinforcement or an independent secondary lock may depend on the type of terminal cavities in a connector and/or the type of application. A single connector may include both a primary lock reinforcement and an independent secondary lock. In this case, the primary lock reinforcement and the independent secondary lock must be independently moved when the connector is assembled or serviced, increasing the cost and complexity of the connector relative to conventional connectors.

While known independent secondary locks have worked well in the past, due to the demand for redesign of products to meet new specifications, space constraints do not allow known independent secondary locks to work in all applications.

It would, therefore, be beneficial to provide a connector with an independent secondary lock which can operate in a compact electrical connector. It would also be beneficial to provide an independent secondary lock which can be added as a separate piece to the housing of the electrical connector.

SUMMARY OF THE INVENTION

An embodiment is directed to a connector assembly having a connector housing with a mating face and a wire receiving face. A terminal receiving area extends from the mating face toward the wire receiving face. The terminal receiving area is spaced from outside walls of the connector housing and has a secondary lock receiving recess and terminal receiving cavities extending from the mating face to the wire receiving face. A secondary lock member is slidably received in the secondary lock receiving recess for movement between a first position and a second position. The secondary lock member cooperates with terminals positioned in the terminal receiving cavities when the secondary lock member is in the second position. The secondary lock member has a resilient positioning member extending from a first wall of the secondary lock member in a direction away from the terminal receiving area. The resilient positioning member is configured to engage a mating component and compress when the mating component is inserted into the connector housing. The resilient positioning member maintains the secondary lock member in the second position as the mating component is inserted into the connector housing. The resilient positioning member cooperates with the mating component to maintain the mating component in the connector housing.

An embodiment is directed to a connector assembly having a connector housing with a mating face and a wire receiving face. A terminal receiving area extends from the mating face toward the wire receiving face. The terminal receiving area is spaced from outside walls of the connector housing. The terminal receiving area has a secondary lock receiving recess and terminal receiving cavities which extend from the mating face to the wire receiving face. The terminal receiving area has slots extending from a first portion of the secondary lock receiving recess to a second portion of the secondary lock receiving recess. The slots positioned between respective terminal receiving cavities. A secondary lock member is slidably received in the secondary lock receiving recess for movement between a first position and a second position. The secondary lock member has locking walls which extend from a first wall of the secondary lock member to a second wall of the secondary lock member. The locking walls extend into the slots of the terminal receiving area and has locking projections which cooperate with terminals positioned in the terminal receiving cavities when the secondary lock member is in the second position. The secondary lock member has a resilient positioning member extending from the first wall in a direction away from the locking walls. The resilient positioning member is configured to engage a mating component and compress when the mating component is inserted into the connector housing. The resilient positioning member maintains the secondary lock member in the second position as the mating component is inserted into the connector housing.

An embodiment is directed to a connector assembly having a connector housing with a mating face and a wire receiving face. A terminal receiving area extends from the mating face toward the wire receiving face. The terminal receiving area has a secondary lock receiving recess. The terminal receiving area has terminal receiving cavities extending from the mating face to the wire receiving face. The terminal receiving area has slots which positioned between respective terminal receiving cavities. A secondary lock member is moveable between a first position and a second position. The secondary lock member cooperates with terminals positioned in the terminal receiving cavities when the secondary lock member is in the second position. The secondary lock member has locking walls which extend from a first wall of the secondary lock member to a second wall of the secondary lock member. The locking walls extend into the slots of the terminal receiving area. The locking walls having locking projections which cooperate with terminals positioned in the terminal receiving cavities when the secondary lock member is in the second position. The secondary lock member has a resilient positioning member extending from the first wall of the secondary lock member in a direction away from the terminal receiving area. Wherein when the secondary lock member is in the first position, the resilient positioning member is configured to engage the mating component and prevent the mating component from being inserted into the connector housing. When the secondary lock member is in the second position, the resilient positioning member is configured to engage the mating component and compress when the mating component is inserted into the connector housing, the resilient positioning member maintaining the secondary lock member in the second position as the mating component is inserted into the connector housing.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
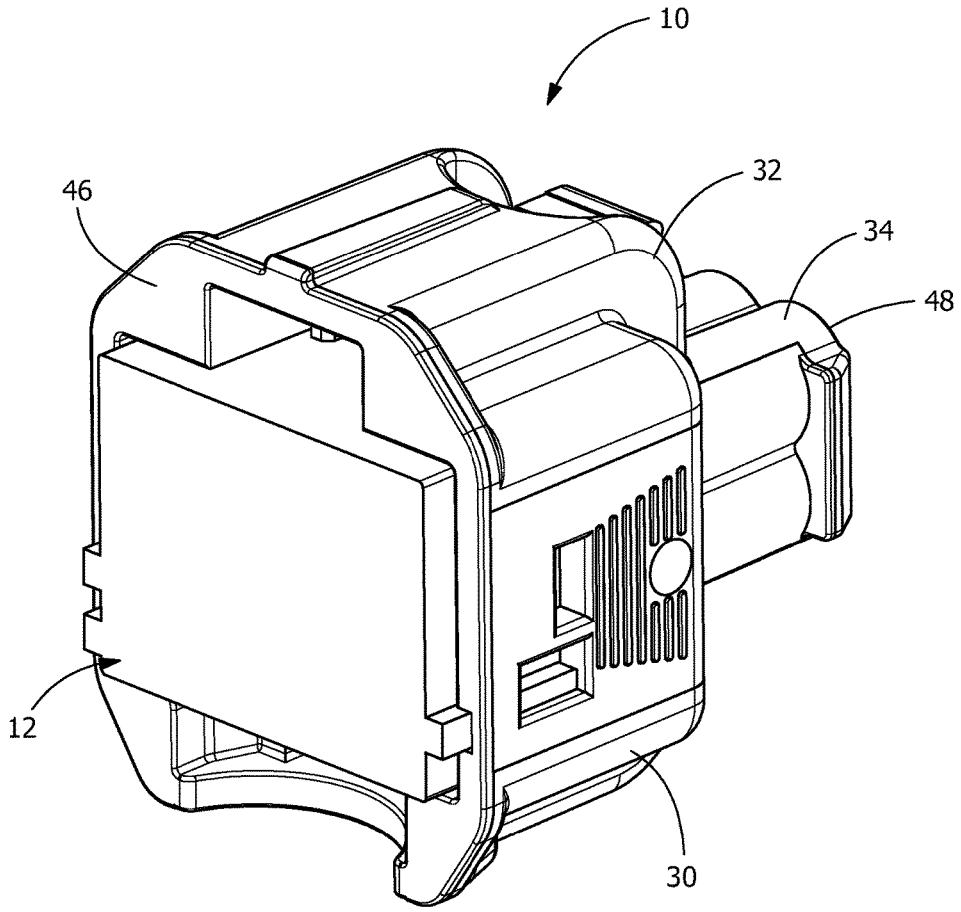
FIG. 1 is a perspective view of a connector assembly of the present invention with a mating component mated thereto.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

The connector assembly of the subject invention is identified generally by the numeral 10 in FIG. 1. The connector assembly 10 is intended for mating to a mating connector or component which is identified generally by the numeral 12 in FIG. 1. Such mating components 12 may be used in various industries, including, but not limited to, automotive, commercial vehicles and consumer electronics. The mating component 12 to which the connector assembly 10 is mated includes a housing 14 of generally opened rectangular configuration and defining a mating end 16 and a back end 18. Tapered side walls 20 and end walls 22 extend from the back end 18 to the mating end 16. Terminals 24 are mounted within the rectangular housing 14 and project toward the open mating end 16. A pair of locking projections 26 extend from the end walls 22 and project from the exterior of the housing 14. The electrical connector assembly 10 is lockingly and sealingly engageable with the mating component 12 to provide a high quality electrical connection therebetween.

The connector assembly 10 includes an insulator housing 30 which is unitarily molded from plastic or other material having the strength and insulative characteristics required. The insulator housing 30 includes a mating end 32 and an opposed wire receiving end 34. The mating end 32 of the housing 30 defines the portion of the connector assembly 10 that is lockingly engageable with the housing 14 of the mating component 12.

Figure 2:
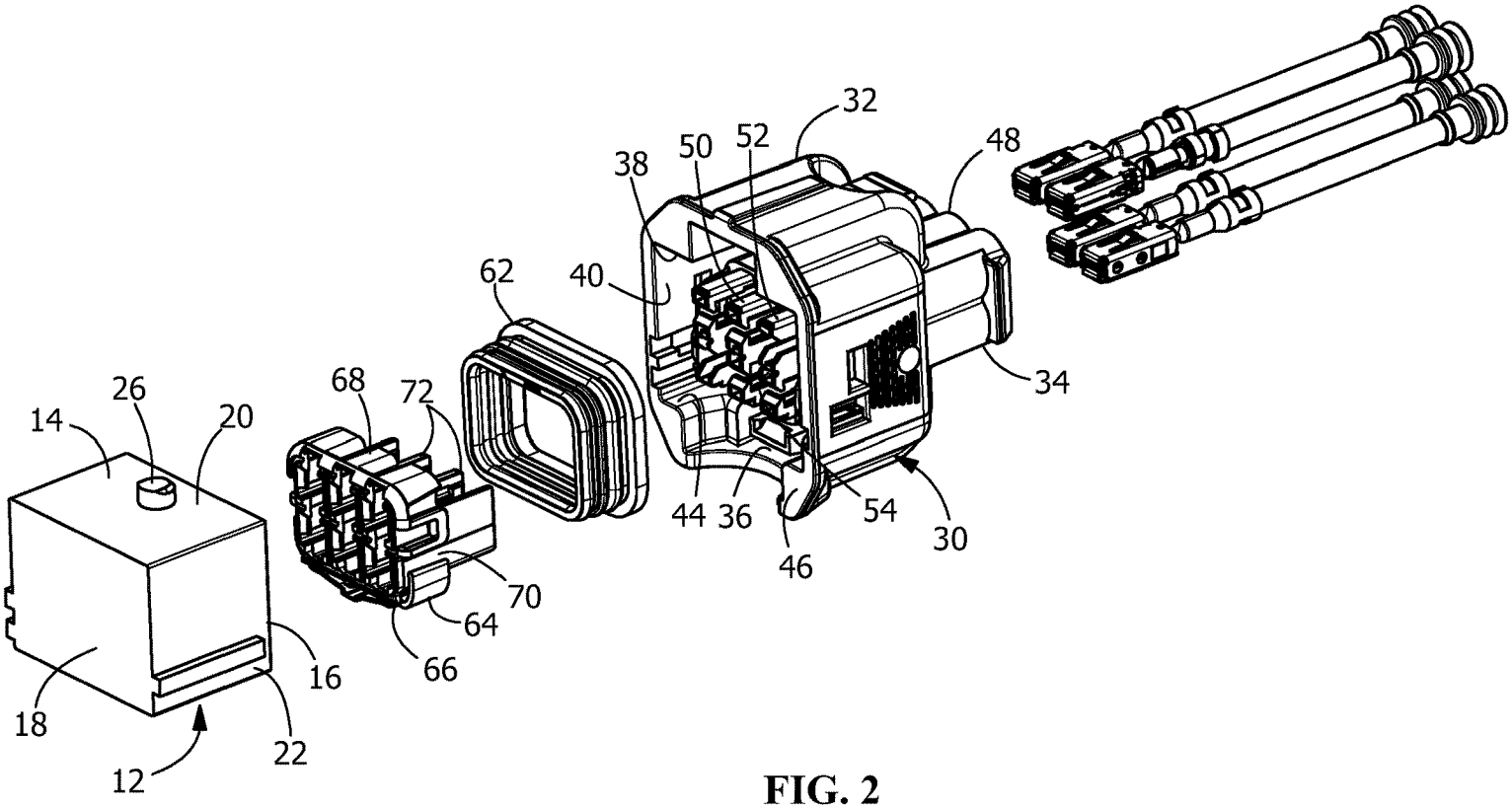
FIG. 2 is an exploded perspective view of the connector assembly and the mating component.
Figure 6:
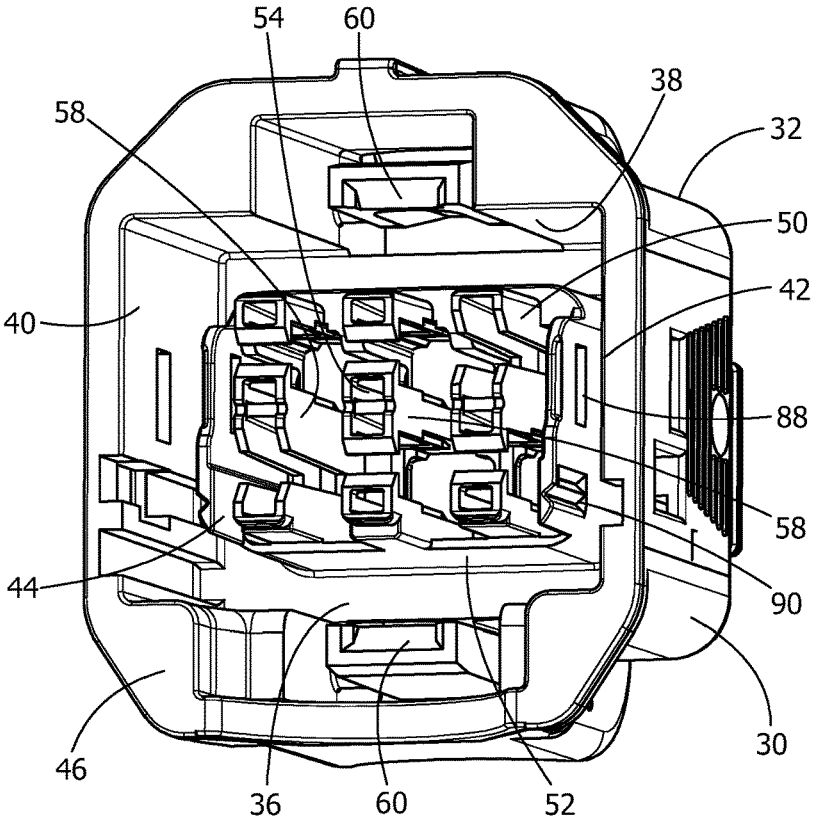
FIG. 6 is a top perspective view of a housing of the connector assembly of FIG. 1.

As shown in the illustrative embodiments of FIGS. 2 and 6, the housing 30 is of unitary molded construction and of generally rectangular external configuration, with a front wall 36, an opposed back wall 38 and side walls 40, 42 which extend between the front wall 36 and the back wall 38. A component receiving opening 44 extends between the front wall 36, the back wall 38 and the side walls 40, 42. The component receiving opening 44 extends from a mating face 46 of the mating end 32 toward a wire receiving face 48 of the wire mounting end 34. The component receiving opening 44 is dimensioned to receive the housing 14 of the mating component 12 therein.

A terminal receiving area 50 is provided in the mating end 32 and extends into the component receiving opening 44. The terminal receiving area 50 is spaced from the front wall 36, the back wall 38 and the end walls 40, 42 such that a secondary lock receiving recess 52 is provided between the terminal receiving area 50 and the walls 36, 38, 40, 42. Terminal receiving cavities 54 extend from the wire receiving end 34 into the terminal receiving area 50. The spacing and configuration of the terminal receiving cavities 54 can vary depending upon the application and the size of the terminals 56 inserted therein.

Slots 58, as best shown in FIG. 6, are provided in the terminal receiving area 50. The slots 58 extend from the portion of the secondary lock receiving recess 52 which is positioned proximate to the front wall 36 to the portion of the secondary lock receiving recess 52 which is positioned proximate to the back wall 38. The slots 58 extend from proximate the mating face 46 toward the wire receiving face 48. The slots 58 are adjacent to the terminal receiving cavities 54, such that slots 58 are open to the terminal receiving cavities 54 is various areas.

Figure 7:
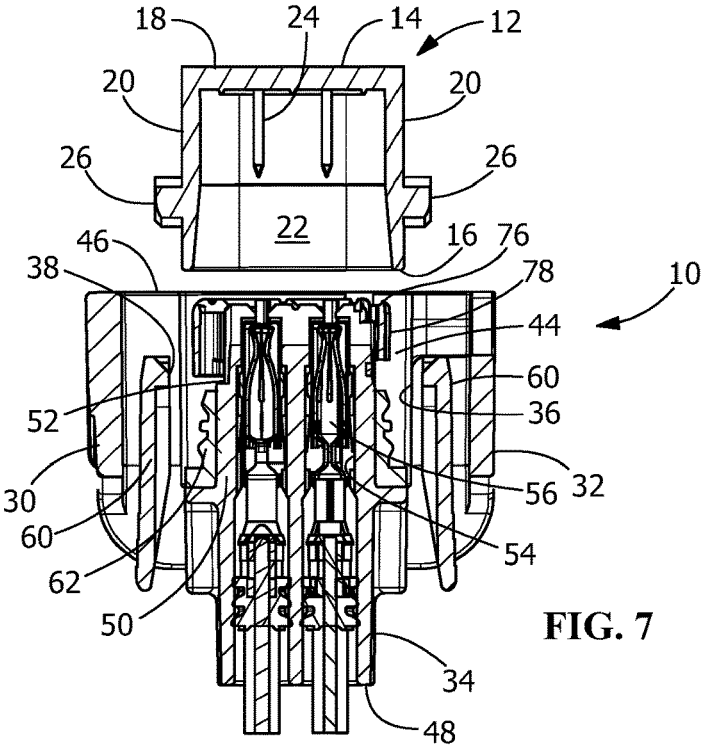
FIG. 7 is a cross-sectional view of the connector assembly of FIG. 1 prior to the insertion of the mating component.
Figure 8:
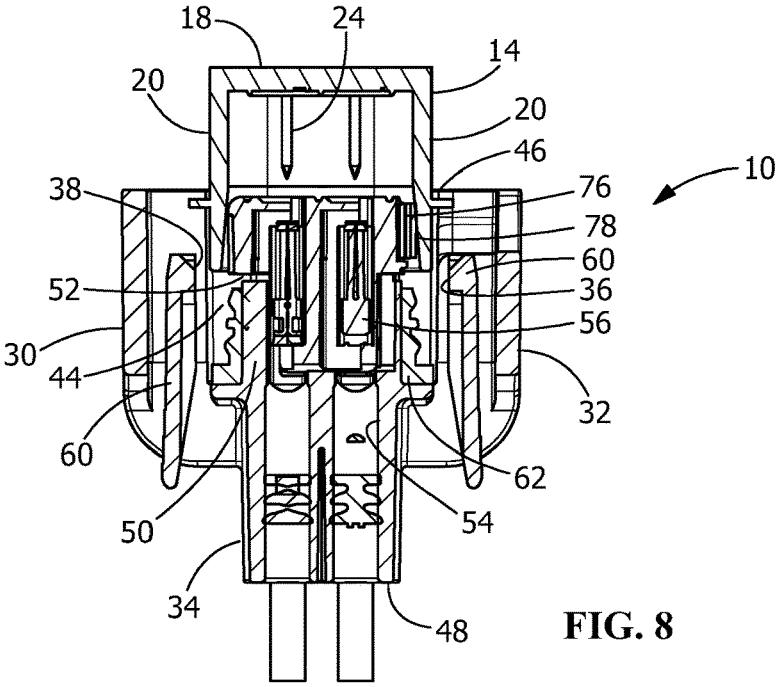
FIG. 8 is a cross-sectional view of the connector assembly as the insertion of the mating component into the connector assembly occurs.
Figure 10:
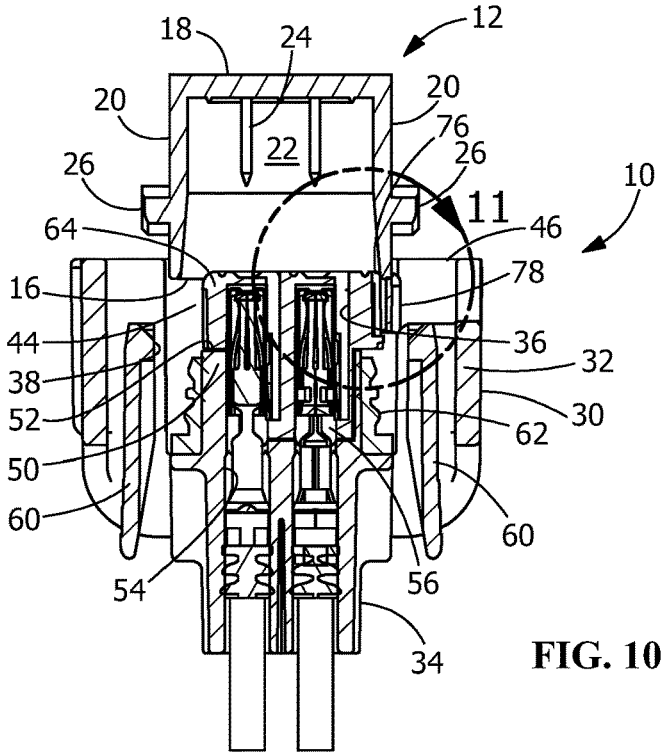
FIG. 10 is a cross-sectional view of the connector assembly of FIG. 1 prior to the insertion of the mating component with the secondary lock member not properly positioned.

As best shown in FIGS. 7, 8 and 10, a resilient latching arm 60 is provided in the mating end 32. The latching arm 60 is configured to cooperate with the locking projections 26 to retain the mating component 12 when the mating component 12 is fully inserted into the component receiving opening 44. A mating seal 62 is provided in the component receiving opening 44. The mating seal 62 engages side walls 20 and end walls 22 of the mating component 12 when the mating component 12 is fully inserted into the component receiving opening 44 to provide a seal between the mating component 12 and the terminal receiving area 50.

The housing 30 is made from plastic or other material having the insulation and strength characteristics required. The mating seal 36 is made from silicon or other material having the deformable and water resistant characteristics required to allow the mating end 16 of the housing 14 of the component 12 to form a water tight seal with the mating seal 62.

A secondary lock member 64 is configured to be received in the secondary lock receiving recess 52. The secondary lock member 64 has a first or front wall 66, a second or back wall 68 and end walls 70. The end walls 70 are spaced apart a distance which is essentially equal to or slightly larger than the distance between end walls 40, 42, thereby preventing or minimizing the movement of the secondary lock member 64 in a direction of the longitudinal axis of the mating face 46. The front wall 66 and back wall 68 are spaced apart a distance which is larger than the distance between the front wall 36 and the back wall 38, thereby allowing the movement of the secondary lock member 64 in a direction which is transverse to the longitudinal axis of the mating face 46.

Locking walls 72 extend from the first or front wall 66 of the secondary lock member 64 to the second or back wall 68 of the secondary lock member 64. The locking walls are positioned in the slots 58 of the terminal receiving area 50. Each locking wall 72 has a plurality of locking projections 74 which extend from locking wall 72 in a direction which is transverse to the longitudinal axis of the terminals 56 positioned in the terminal receiving cavities 54. The locking projections 74 are positioned outside of the terminal receiving cavities 54 when the secondary lock member 64 is in a first position. The locking projections 74 are positioned in the terminal receiving cavities 54 when the secondary lock member 64 is in a second position.

Figure 3:
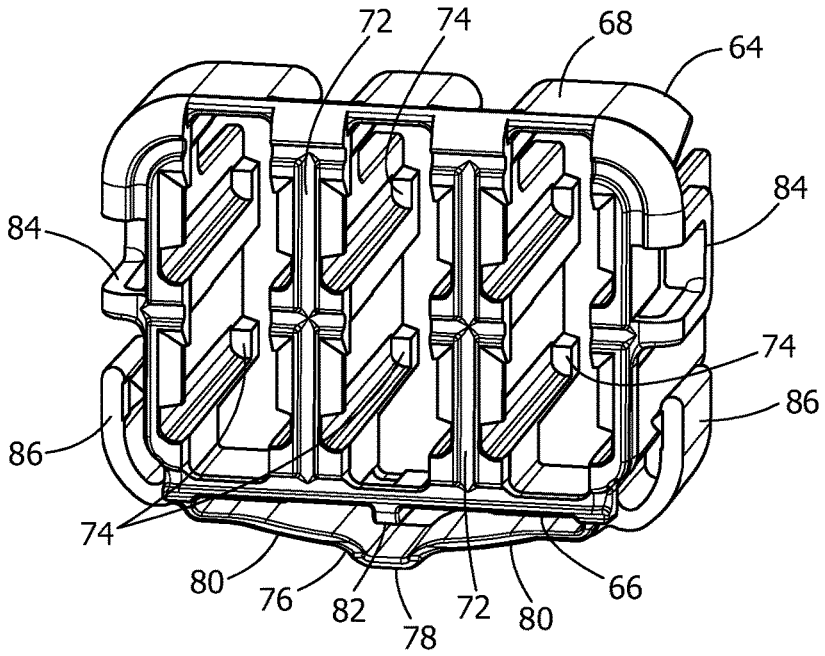
FIG. 3 is a top perspective view of a secondary lock member used in the connector assembly of FIG. 1.
Figure 4:
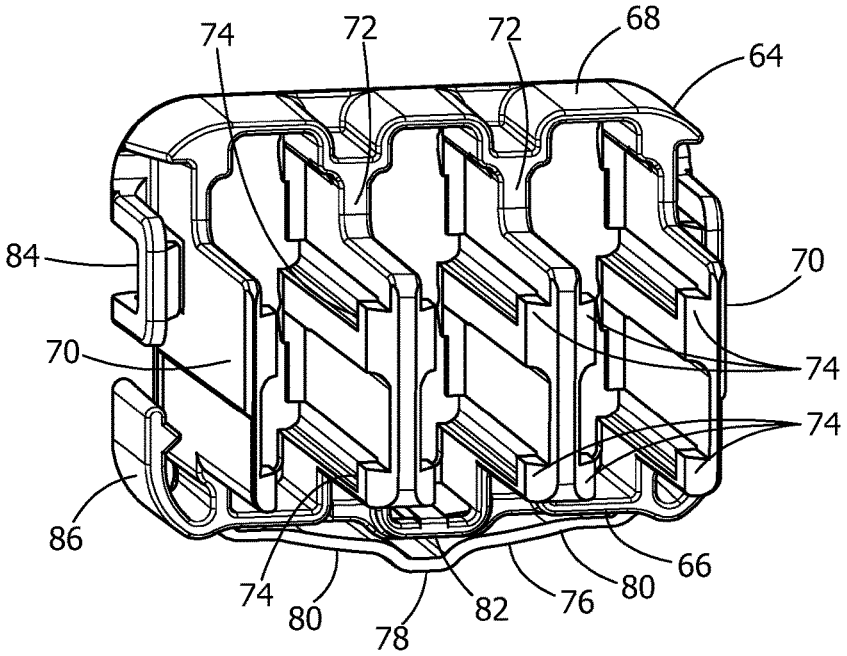
FIG. 4 is a bottom perspective view of the secondary lock member of FIG. 3.
Figure 5:
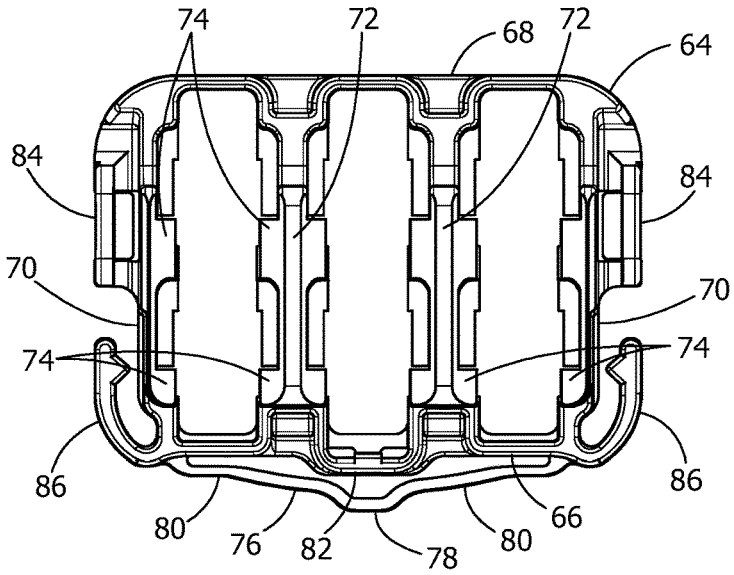
FIG. 5 is a bottom view of the secondary lock member of FIG. 3.

As best shown in FIGS. 3 through 5, a resilient positioning member 76 is provided on the secondary lock member 64. The resilient positioning member 76 extends from the first or front wall 66 of the secondary lock member 64 in a direction away from the locking walls 72 and into the component receiving opening 44. The resilient positioning member 76 is positioned proximate the mating face 46. The resilient positioning member 76 is unitarily molded into the insulator housing 30.

The resilient positioning member 76 includes an engagement portion 78 and support arms 80 which are attached to the engagement portion 78 at one end and to the first or front wall 66 at the other end. A projection 82 extends from the first or front wall 66 toward the engagement portion 78.

Latching arms 84, 86 extend from the end walls 70 of the secondary lock member 64. The latching arms 84, 86 are configured to cooperate with projections 88, 90 (FIG. 6) of the end walls 40, 42 of the terminal receiving area 50 to retain the secondary lock member 64 in position on the terminal receiving area 50 while allowing the movement of the secondary lock member 64 relative to the terminal receiving area 50 in a direction with is transverse to the longitudinal axis of the mating face 46.

Figure 9:
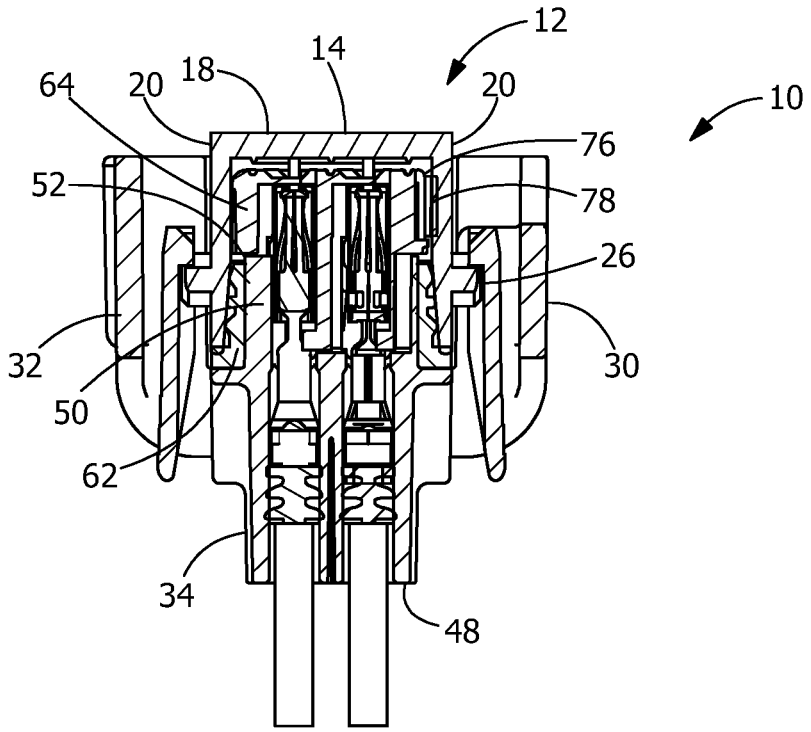
FIG. 9 is a cross-sectional view of the connector assembly with the mating component fully inserted.

Referring to FIGS. 7 through 9, the insertion of the mating component 12 into the connector assembly 10 is illustrated. As shown in FIG. 7, the terminals 56 are inserted into the terminal receiving cavities 54. The secondary lock member 64 is inserted into the secondary lock receiving recess 52 and retained on the terminal receiving area 50 by the latching arms 84, 86. In the embodiment shown in FIG. 7, the secondary lock member 64 is provided in the second position. In this position, the locking projections 74 of the locking walls 72 of the secondary lock member 64 are positioned in the terminal receiving cavities 54 and in engagement with the terminals 56 to prevent the unwanted removal of the terminals 56 from the terminal receiving cavities 54. With the secondary lock member 64 properly positioned in the second position, the engagement portion 78 of the resilient positioning member 76 is spaced from the first or front wall 36 of the housing 30.

As the mating component 12 is inserted into the component receiving opening 44, a tapered side wall 20 of the mating component 12 engages the engagement portion 78 of the resilient positioning member 76, as shown in FIG. 8. As insertion continues, the tapered side wall 20 causes the engagement portion 78 of the resilient positioning member 76 and the support arms 80 to be compressed or moved toward the first or front wall 66 of the secondary lock member 64. This causes the secondary lock member 64 to be properly maintained in the second position.

With the mating component 12 fully inserted into the component receiving opening 44 and into the connector assembly 10, as shown in FIG. 9, the forces exerted by the mating component 12 on the resilient positioning member 76 prevent the inadvertent movement of the secondary lock member 64 to the first position and the inadvertent removal of the terminals 56. In addition, the force exerted by the resilient positioning member 76 on the mating component 12 helps to secure the mating component in the component receiving opening 44 of the connector assembly 10.

Figure 11:
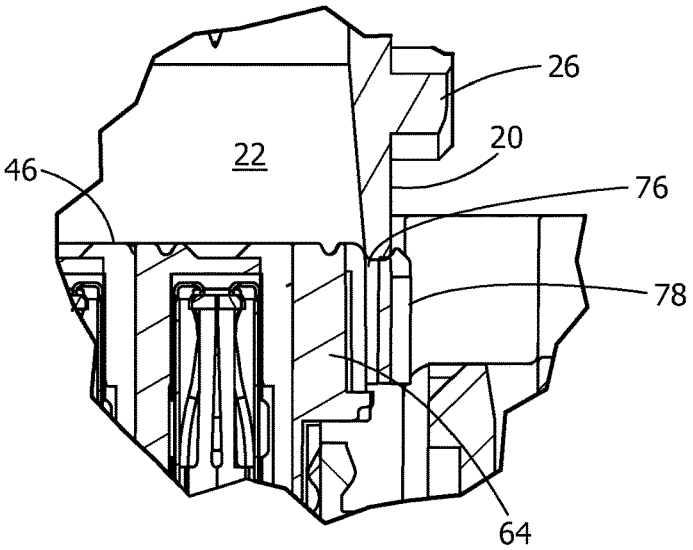
FIG. 11 is an enlarged cross-sectional view of the connector assembly of FIG. 1 illustrating the inability of the mating component to be inserted into the connector assembly occurs when the secondary lock member not properly positioned.

As shown in FIGS. 10 and 11, if the secondary lock member 64 is in the first position or has not been properly positioned in the second position, the engagement portion 78 of the resilient positioning member 76 is positioned proximate to or in engagement with the first or front wall 36 of the housing 30. Consequently, as shown in FIG. 11, as the mating component 12 is inserted into the component receiving opening 44, the tapered side wall 20 of the mating component 12 is positioned between the engagement portion 78 and the first or front wall 66 of the secondary lock member 64. In this position, the tapered side wall 20 cannot move the engagement portion 78 of the resilient positioning member 76 and the support arms 80 toward the first or front wall 66 of the secondary lock member 64. Consequently, the further insertion of the mating component 12 is prevented.

The use of the engagement portion 78 of the resilient positioning member 76 of the secondary lock member 64 provides a positive indication of the positioning of the secondary lock member 64 while allowing the connector assembly to have a reduced height. This is of benefit in applications in which the physical dimensions of the connector assembly 10 is limited. In particular, as the secondary lock member 64 and the mating seal 62 can be provided in the same area allowing for a reduction in height of the sealing region of the connector assembly 10.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A connector assembly comprising:

a connector housing having a mating face and a wire receiving face, a terminal receiving area extends from the mating face toward the wire receiving face, the terminal receiving area being spaced from outside walls of the connector housing, the terminal receiving area having a secondary lock receiving recess, the terminal receiving area having terminal receiving cavities extending from the mating face to the wire receiving face;

a secondary lock member slidably received in the secondary lock receiving recess for movement between a first position and a second position, the secondary lock member cooperates with terminals positioned in the terminal receiving cavities when the secondary lock member is in the second position;

the secondary lock member having a resilient positioning member extending from a first wall of the secondary lock member in a direction away from the terminal receiving area, the resilient positioning member configured to engage a mating component and compress when the mating component is inserted into the connector housing, the resilient positioning member maintaining the secondary lock member in the second position as the mating component is inserted into the connector housing; and wherein the resilient positioning member cooperates with the mating component to maintain the mating component in the connector housing.

2. The connector assembly as recited in claim 1, wherein the terminal receiving area has slots extending from a first portion of the secondary lock receiving recess to a second portion of the secondary lock receiving recess, the slots positioned between respective terminal receiving cavities.

3. The connector assembly as recited in claim 2, wherein the secondary lock member has locking walls which extend from the first wall of the secondary lock member to a second wall of the secondary lock member, the locking walls extend into the slots of the terminal receiving area, the locking walls have locking projections which cooperate with terminals positioned in the terminal receiving cavities when the secondary lock member is in the second position.

4. The connector assembly as recited in claim 3, wherein each locking wall has a plurality of locking projections which extend from the respective locking wall in a direction which is transverse to a longitudinal axis of the terminals positioned in the terminal receiving cavities, the locking projections are positioned outside of the terminal receiving cavities when the secondary lock member is in the first position, and the locking projections are positioned in the terminal receiving cavities when the secondary lock member is in the second position.

5. The connector assembly as recited in claim 1, wherein the secondary lock member has a first wall, a second wall and end walls, the end walls are spaced apart a distance which is essentially equal to the distance between end walls of the terminal receiving area, thereby preventing or minimizing the movement of the secondary lock member in a direction of a longitudinal axis of the mating face of the connector housing.

6. The connector assembly as recited in claim 1, wherein the first wall and second wall are spaced apart a distance which is larger than the distance between a front wall and the back wall of the terminal receiving area, thereby allowing the movement of the secondary lock member in a direction which is transverse to a longitudinal axis of the mating face.

7. The connector assembly as recited in claim 1, wherein the resilient positioning member is positioned proximate the mating face, wherein the resilient positioning member engages the mating component and prevents the insertion of the mating component into the connector housing when the secondary lock member is in the first position.

8. The connector assembly as recited in claim 7, wherein the resilient positioning member includes an engagement portion and support arms which are attached to the engagement portion at one end and to the first wall at the other end.

9. The connector assembly as recited in claim 1, wherein latching arms extend from end walls of the secondary lock member, the latching arms are configured to cooperate with projections of the end walls of the terminal receiving area to retain the secondary lock member in position on the terminal receiving area while allowing the movement of the secondary lock member relative to the terminal receiving area in a direction with is transverse to a longitudinal axis of the mating face.

10. A connector assembly comprising:

a connector housing having a mating face and a wire receiving face, a terminal receiving area extends from the mating face toward the wire receiving face, the terminal receiving area being spaced from outside walls of the connector housing, the terminal receiving area having a secondary lock receiving recess, the terminal receiving area having terminal receiving cavities extending from the mating face to the wire receiving face, the terminal receiving area having slots extending from a first portion of the secondary lock receiving recess to a second portion of the secondary lock receiving recess, the slots positioned between respective terminal receiving cavities;

a secondary lock member slidably received in the secondary lock receiving recess for movement between a first position and a second position, the secondary lock member having locking walls which extend from a first wall of the secondary lock member to a second wall of the secondary lock member, the locking walls extend into the slots of the terminal receiving area, the locking walls having locking projections which cooperate with terminals positioned in the terminal receiving cavities when the secondary lock member is in the second position;

the secondary lock member having a resilient positioning member extending from the first wall in a direction away from the locking walls, the resilient positioning member configured to engage a mating component and compress when the mating component is inserted into the connector housing, the resilient positioning member maintaining the secondary lock member in the second position as the mating component is inserted into the connector housing.

11. The connector assembly as recited in claim 10, wherein each locking wall has a plurality of locking projections which extend from the respective locking wall in a direction which is transverse to a longitudinal axis of the terminals positioned in the terminal receiving cavities, the locking projections are positioned outside of the terminal receiving cavities when the secondary lock member is in the first position, and the locking projections are positioned in the terminal receiving cavities when the secondary lock member is in the second position.

12. The connector assembly as recited in claim 11, wherein the secondary lock member has the first wall, a second wall and end walls, the end walls are spaced apart a distance which is essentially equal to the distance between end walls of the terminal receiving area, thereby preventing or minimizing the movement of the secondary lock member in a direction of a longitudinal axis of the mating face of the connector housing.

13. The connector assembly as recited in claim 12, wherein the first wall and the second wall are spaced apart a distance which is larger than the distance between a front wall and a back wall of the terminal receiving area, thereby allowing the movement of the secondary lock member in a direction which is transverse to a longitudinal axis of the mating face.

14. The connector assembly as recited in claim 13, wherein the resilient positioning member is positioned proximate the mating face, wherein the resilient positioning member engages the mating component and prevents the insertion of the mating component into the connector housing when the secondary lock member is in the first position.

15. The connector assembly as recited in claim 14, wherein the resilient positioning member includes an engagement portion and support arms which are attached to the engagement portion at one end and to the first wall at the other end.

16. The connector assembly as recited in claim 15, wherein latching arms extend from end walls of the secondary lock member, the latching arms are configured to cooperate with projections of the end walls of the terminal receiving area to retain the secondary lock member in position on the terminal receiving area while allowing the movement of the secondary lock member relative to the terminal receiving area in a direction with is transverse to a longitudinal axis of the mating face.

17. A connector assembly comprising:

a connector housing having a mating face and a wire receiving face, a terminal receiving area extends from the mating face toward the wire receiving face, the terminal receiving area having a secondary lock receiving recess, the terminal receiving area having terminal receiving cavities extending from the mating face to the wire receiving face, the terminal receiving area having slots positioned between respective terminal receiving cavities;

a secondary lock member which is moveable between a first position and a second position, the secondary lock member cooperates with terminals positioned in the terminal receiving cavities when the secondary lock member is in the second position; the secondary lock member having locking walls which extend from a first wall of the secondary lock member to a second wall of the secondary lock member, the locking walls extend into the slots of the terminal receiving area, the locking walls having locking projections which cooperate with terminals positioned in the terminal receiving cavities when the secondary lock member is in the second position;

the secondary lock member having a resilient positioning member extending from the first wall of the secondary lock member in a direction away from the terminal receiving area;

wherein when the secondary lock member is in the first position, the resilient positioning member is configured to engage the mating component and prevent the mating component from being inserted into the connector housing; and wherein when the secondary lock member is in the second position, the resilient positioning member is configured to engage the mating component and compress when the mating component is inserted into the connector housing, the resilient positioning member maintaining the secondary lock member in the second position as the mating component is inserted into the connector housing.

18. The connector assembly as recited in claim 17, wherein the resilient positioning member includes an engagement portion and support arms which are attached to the engagement portion at one end and to the first wall at the other end.

19. The connector assembly as recited in claim 18, wherein latching arms extend from end walls of the secondary lock member, the latching arms are configured to cooperate with projections of the end walls of the terminal receiving area to retain the secondary lock member in position on the terminal receiving area while allowing the movement of the secondary lock member relative to the terminal receiving area in a direction with is transverse to a longitudinal axis of the mating face.

20. The connector assembly as recited in claim 19, wherein the secondary lock member has the first wall, the second wall and end walls, the end walls are spaced apart a distance which is essentially equal to the distance between end walls of the terminal receiving area, thereby preventing or minimizing the movement of the secondary lock member in a direction of a longitudinal axis of the mating face of the connector housing, the first wall and the second wall are spaced apart a distance which is larger than the distance between a front wall and a back wall of the terminal receiving area, thereby allowing the movement of the secondary lock member in a direction which is transverse to a longitudinal axis of the mating face.

* * * * *